US010491988B2

(12) United States Patent
Zeng

(10) Patent No.: US 10,491,988 B2
(45) Date of Patent: Nov. 26, 2019

(54) AUDIO DEVICE HAVING RADIO RECEPTION/BLUETOOTH/WI-FI FUNCTIONS

(71) Applicant: Shenzhen Airsmart Technology Co., Ltd, Shenzhen, Guangdong (CN)

(72) Inventor: Dejun Zeng, Guangdong (CN)

(73) Assignee: Shenzhen Airsmart Technology Co., Ltd, Shenzhen (CN)

( * ) Notice: Subject to any disclaimer, the term of this patent is extended or adjusted under 35 U.S.C. 154(b) by 0 days.

(21) Appl. No.: 16/357,299

(22) Filed: Mar. 18, 2019

(65) Prior Publication Data

US 2019/0215601 A1 Jul. 11, 2019

Related U.S. Application Data

(63) Continuation of application No. PCT/CN2016/099352, filed on Sep. 19, 2016.

(51) Int. Cl.
*H04R 1/02* (2006.01)
*H04R 1/28* (2006.01)

(52) U.S. Cl.
CPC ..... *H04R 1/2826* (2013.01); *H04R 1/021* (2013.01); *H04R 1/023* (2013.01); *H04R 1/025* (2013.01); *H04R 1/028* (2013.01); *H04R 2420/07* (2013.01); *H04R 2430/01* (2013.01)

(58) Field of Classification Search
CPC ..... H04R 1/02; H04R 1/021; H04R 1/023; H04R 1/025; H04R 1/028; H04R 1/2803; H04R 1/2826; H04R 2420/07; H04R 2430/01; H04R 2201/028; H04R 2227/005; H04R 3/00; H04R 3/04
See application file for complete search history.

(56) References Cited

U.S. PATENT DOCUMENTS 5,502,772 A * 3/1996 Felder ..... H04R 1/20 181/199
9,071,906 B2 * 6/2015 Hogue ..... H04R 3/12
9,143,861 B2 * 9/2015 Schul ..... H04R 27/00
(Continued)

FOREIGN PATENT DOCUMENTS

CN 105554618 A 5/2016

OTHER PUBLICATIONS

International Search Report of PCT Patent Application No. PCT/CN2016/099352 dated Jun. 28, 2017.

*Primary Examiner* — Thang V Tran

(57) ABSTRACT

An audio device having radio reception/Bluetooth/Wi-Fi functions is disclosed, comprising a device core having a uniform casing size, and a personalized outer casing used to accommodate the device core. The device core comprises a casing, a circuit board disposed within the casing, a speaker electrically connected to the circuit board, a regulation unit, a display unit, and a power supply unit. The regulation unit comprises at least one of a tuning unit or a volume regulation unit. The audio device further comprises at least one manual regulation device fitted for each regulation unit. The personalized outer casing is provided with a sound transmission channel for the speaker. A movement channel is provided on the personalized outer casing to allow the manual regulation device to extend outside of the outer casing. The audio device of the present application has various functions and enables DIY of accessories.

13 Claims, 5 Drawing Sheets

(56) References Cited

U.S. PATENT DOCUMENTS

| | | | | |
|---|---|---|---|---|
| 9,843,851 | B2 * | 12/2017 | Chamberlin | H04R 1/028 |
| 2012/0177230 | A1 * | 7/2012 | Cooper | H04R 5/00 381/120 |
| 2013/0177198 | A1 * | 7/2013 | Hogue | H04R 3/12 381/394 |
| 2015/0257091 | A1 * | 9/2015 | Zur | H04L 67/303 455/41.2 |
| 2019/0037307 | A1 * | 1/2019 | Zimmerman | H04R 1/021 |

* cited by examiner

AUDIO DEVICE HAVING RADIO RECEPTION/BLUETOOTH/WI-FI FUNCTIONS

CROSS REFERENCE TO RELATED APPLICATIONS

The present application is a Continuation Application of PCT Application No. PCT/CN2016/099352 filed on Sep. 19, 2016, the contents of which are incorporated herein by reference in its entirety.

TECHNICAL FIELD

The present disclosure relates generally to technical field of audio equipments, and more particularly, to an audio device having radio reception/Bluetooth/WI-FI functions, a customization method, and an assembly method thereof.

BACKGROUND

Audio equipments, linked with music culture, is an entertainment tool used for listening music content from mobile devices or radio programs or music from the Internet. With the development of the times, the powerful audio products are gradually springing up which highlights the shortcomings of single-function products. People's demand for individualization is becoming more and more obvious, while more and more products in the market have not changed much but are seriously homogenized. Under the new idea of satisfying individualized demand and pursuing product design culture, the unchanged appearance of products cannot meet people's requirements.

SUMMARY

The object of the present application is to provide an audio device having radio reception/Bluetooth/WI-FI functions which not only has the traditional radio functions, but also has Bluetooth and Wi-Fi functions, satisfying the different requirements of consumers. At the same time, the audio device having radio reception/Bluetooth/WI-FI functions has various DIY (Do It Yourself) accessories (including appearance accessories such as an outer casing, a rotary knob, a dial, a horn mesh cover, a decorative accessory, etc.). In addition, the device core can also have different sound style characteristics for satisfying the aesthetic requirements of different groups of people.

In one aspect, an audio device having radio reception/Bluetooth/WI-FI functions is provided, which comprising a device core having a uniform casing size, and a personalized outer casing of various design styles used to accommodate the device core; wherein the device core comprises a casing, a circuit board disposed within the casing, a speaker and a regulation unit electrically connected to the circuit board respectively; wherein the regulation unit further comprises at least one of a tuning unit or a volume regulation unit; wherein the audio device further comprises at least one manual regulation device fitted for each regulation unit; the personalized outer casing is provided with a sound transmission channel for the speaker and a movement channel for allowing the manual regulation device to extend outside.

Furthermore, the device core further comprises an LED indication unit electrically connected with the circuit board, wherein the personalized outer casing is provided with a light transmission channel with a lens arranged inside at a corresponding position.

Furthermore, the casing comprises a front surface, a rear surface and an enclosure between the front surface and the rear surface, wherein the speaker is movably mounted on the front surface of the casing and the sound transmission channel on the personalized outer casing is opposite to a speaker cone of the speaker.

Furthermore, the front surface of the casing is provided with a groove for installing the speaker, wherein the groove has a groove depth greater than a height and vibration amplitude of the speaker cone, such that an inner wall of the personalized outer casing will not affect a vibration of the speaker cone.

Furthermore, the audio device having radio reception/Bluetooth/WI-FI functions further comprises a decorative horn cloth or a horn network movably arranged on the sound transmission channel of the personalized outer casing.

Furthermore, the audio device having radio reception/Bluetooth/WI-FI functions further comprises a rotary knob, wherein the manual regulation device comprises a frequency tuning or a volume potentiometer, or a shaft of a key or a switching or a shaft combination of which, wherein, one end of the manual regulation device is coupled with a rotating shaft of the regulation unit, and other end of the manual regulation device is coupled with the rotary knob, wherein, the movement channel of the manual regulation device is a through hole.

Furthermore, the audio device having radio reception/Bluetooth/WI-FI functions further comprises a circular or partially circular arc dial mechanically and movably mounted around the movement channel of the manual regulation device.

Furthermore, the audio device having radio reception/Bluetooth/WI-FI functions further comprises a handle, wherein the manual regulation device further comprises a displacement regulation arm of a toggle switch, a displacement potentiometer or a multi-segment switch; wherein the movement channel of the manual regulation device is a narrow long slot, and the handle is inserted or sleeved on the displacement regulation arm.

Furthermore, the audio device having radio reception/Bluetooth/WI-FI functions further comprises a narrow long indication device movably mounted at one side of the narrow long slot.

Furthermore, the audio device having radio reception/Bluetooth/WI-FI functions further comprises a footpad movably mounted on a base of the personalized outer casing via an insertion, clamping or screwing connection.

Furthermore, the personalized outer casing comprises six panels, namely, a front panel, a rear panel, and a top panel, a bottom panel, a left panel and a right panel arranged between the front panel and the rear panel, wherein, the top panel, the bottom panel, the left panel, the right panel and the rear panel are integrated as a whole, wherein the rear panel is pre-retained with connector through holes and sound through holes, while the front panel can be movably mounted at an opening enclosing by the five panels.

Furthermore, the audio device having radio reception/Bluetooth/WI-FI functions at least comprises two personalized outer casings each made of different materials or coated with different patterns.

Furthermore, the audio device having radio reception/Bluetooth/WI-FI functions at least comprises two groups of decorative accessories, manual regulation devices, decorative horn cloths matched with the personalized outer casing.

Furthermore, at least one built-in battery power supply device is retained in the audio device having radio reception/Bluetooth/WI-FI functions.

Furthermore, the audio device having radio reception/Bluetooth/WI-FI functions is further provided with a charging interface, an external antenna interface, a headphone jack interface, an AUX IN input interface, and a self-defined extensible external function connection interface at its rear part.

Furthermore, the power supply unit comprises a rechargeable battery and a charging circuit for charging the rechargeable battery.

Furthermore, the audio device having radio reception/Bluetooth/WI-FI functions further comprises a time/temperature display unit mounted on a panel of the personalized outer casing.

Furthermore, the audio device having radio reception/Bluetooth/WI-FI functions further comprises a tuning indication unit which is prominently mounted on a panel of the device core, wherein the tuning indication unit is electrically connected with the circuit board, and the personalized outer casing is reserved with a visual channel at a corresponding position of the tuning indication unit.

In another aspect, a customization method for an audio device having radio reception/Bluetooth/WI-FI functions connecting a server through WEB or APP is provided, which comprising following steps: S1) sending personal voice preference options to the server which provides sound quality parameters for selection according to a preset table; S2) selecting or setting sound quality parameters by referring to suggestions provided by the server and sending them to the server; 3) recommending speaker options according to above selections by the server; S4) selecting a speaker from the speaker options provided by the server and sending it to the server; S5) selecting a personalized outer casing from multiple personalized outer casings recommended by the server and sending it to the server; S6) selecting a decorative accessory from multiple decorative accessories recommended by the server according to selected personalized outer casing and sending it to the server, wherein the decorative accessory comprises a rotary knob; S7) selecting required function module from function expansion modules recommended by the server according to preference and sending it to the server.

In a further aspect, an assembly method for an audio device having radio reception/Bluetooth/WI-FI functions is provided, which comprising following steps: S1) selecting sound quality parameters according to sound preferences; S2) recommending a speaker according to selected sound quality preferences; S3) selecting a personalized outer casing from recommended personalized outer casings according to the sound quality parameters and the speaker; S4) selecting a decorative accessory from recommended decorative accessories according to selected personalized outer casing, wherein the decorative accessory comprises a rotary knob; S5) installing selected circuit into a casing circuit board, installing the speaker on the personalized outer casing, installing a device core in the personalized outer casing and arranging selected decorative accessory; S6) connecting a function expansion module or device according to reference from external.

When implementing the audio device having radio reception/Bluetooth/WI-FI functions according to the present application, the following beneficial effects can be obtained. By adding Bluetooth and Wi-Fi to the original radio function, the audio device can have more diversified functions. The audio device can be connected to both the traditional radio stations and the Internet to satisfy the requirements of different groups. At the same time, the combination of products and components with diversified styles and shapes can be provided, thus realizing personalized design, and giving the audio device a variety of changing colors and shapes for satisfying the aesthetic requirements of different groups.

BRIEF DESCRIPTION OF THE DRAWINGS

The present application is further illustrated combining the embodiments and drawings as attached.

DETAILED DESCRIPTION OF THE PREFERRED EMBODIMENT

Best Embodiment of the Present Application

Figure 1:
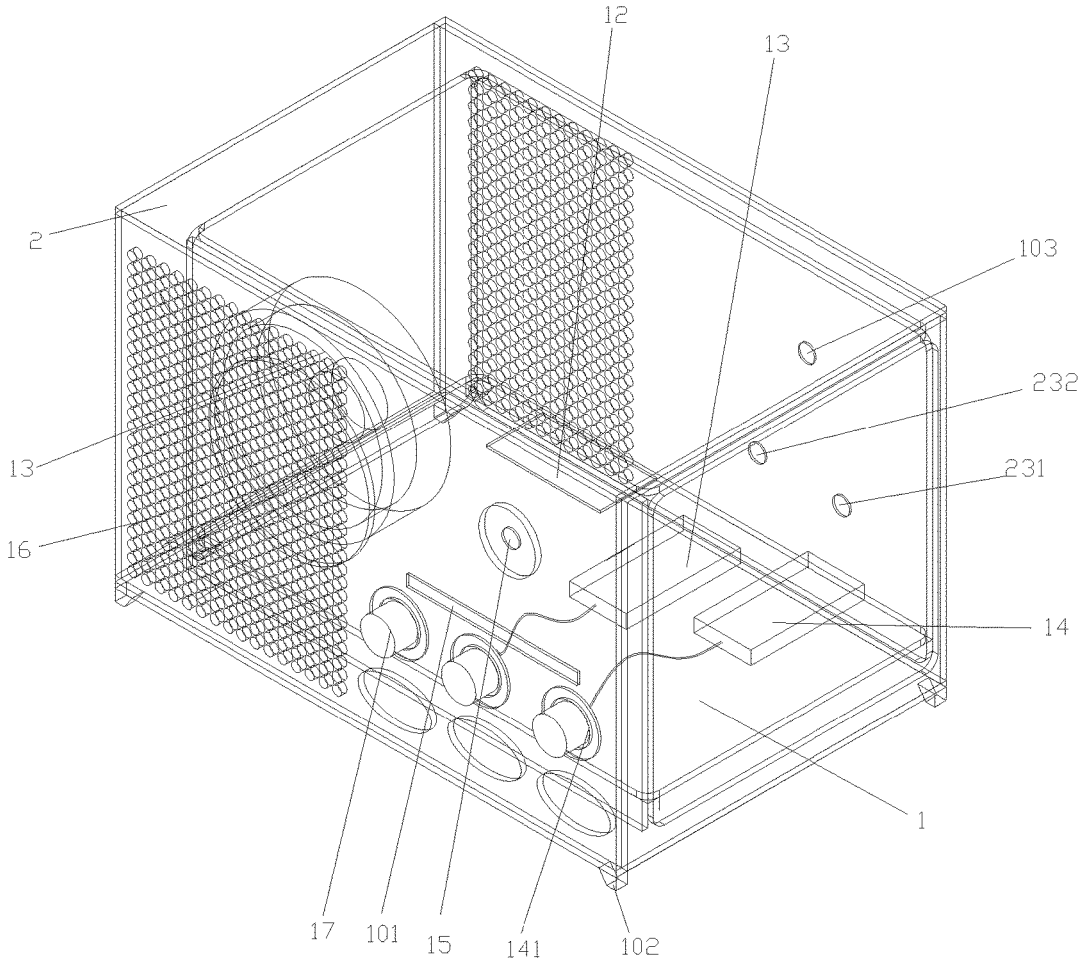
FIG. 1 is a structural perspective diagram of the audio device having radio reception/Bluetooth/WI-FI functions provided by the present application.
Figure 2:
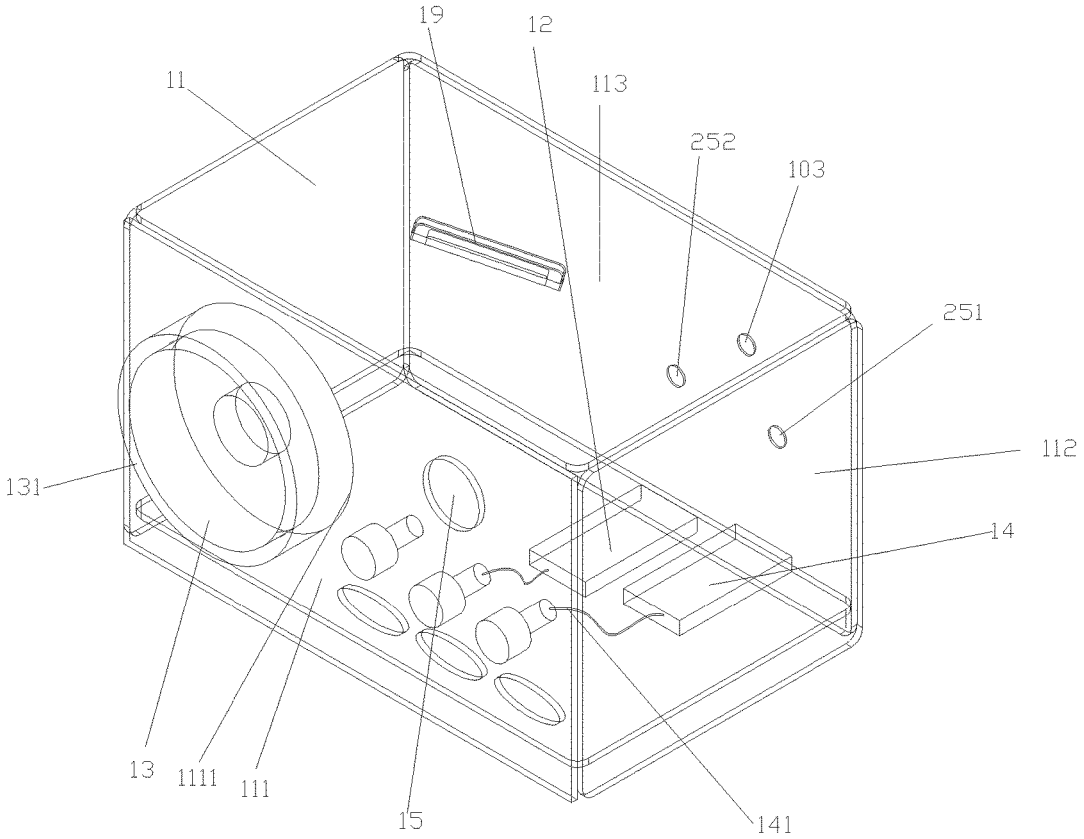
FIG. 2 is a structural diagram of the device core of the audio device having radio reception/Bluetooth/WI-FI functions provided by the present application.
Figure 3:
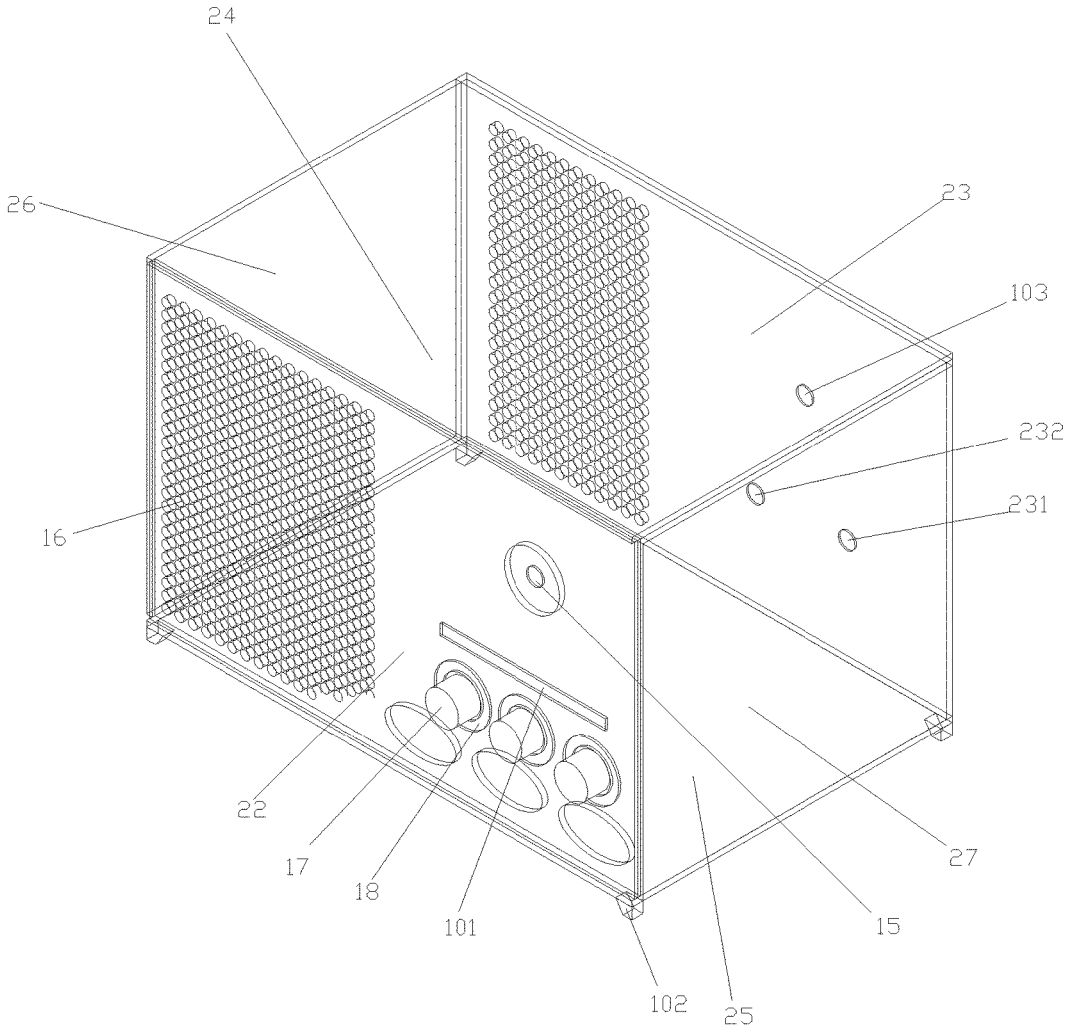
FIG. 3 is a structural diagram of the personalized outer casing of the audio device having radio reception/Bluetooth/WI-FI functions provided by the present application.
Figure 4:
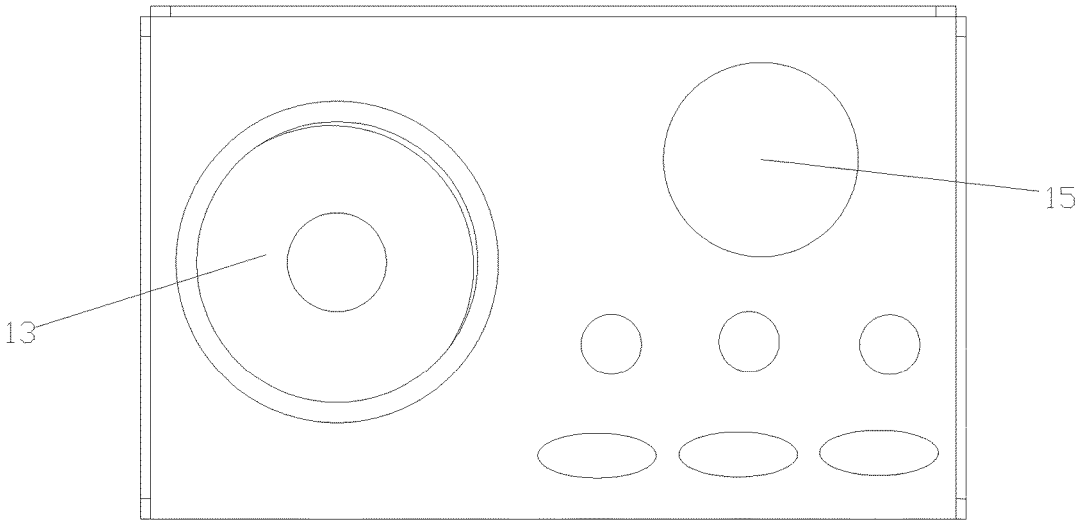
FIG. 4 is a main view of the device core of the audio device having radio reception/Bluetooth/WI-FI functions provided by the present application.
Figure 5:
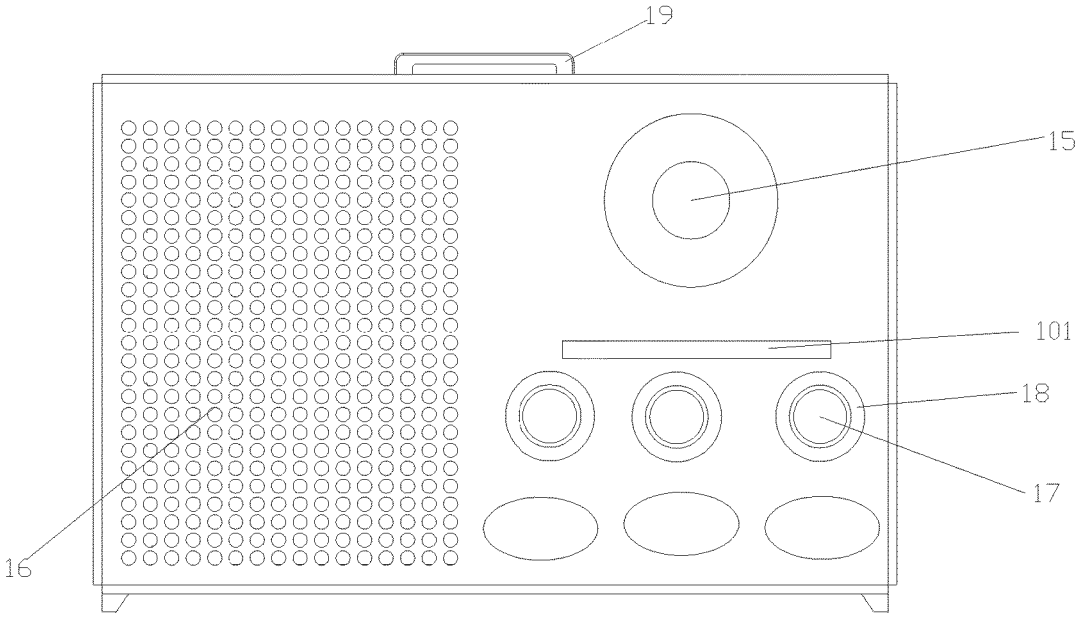
FIG. 5 is a main view of the personalized outer casing of the audio device having radio reception/Bluetooth/WI-FI functions provided by the present application.
Figure 6:
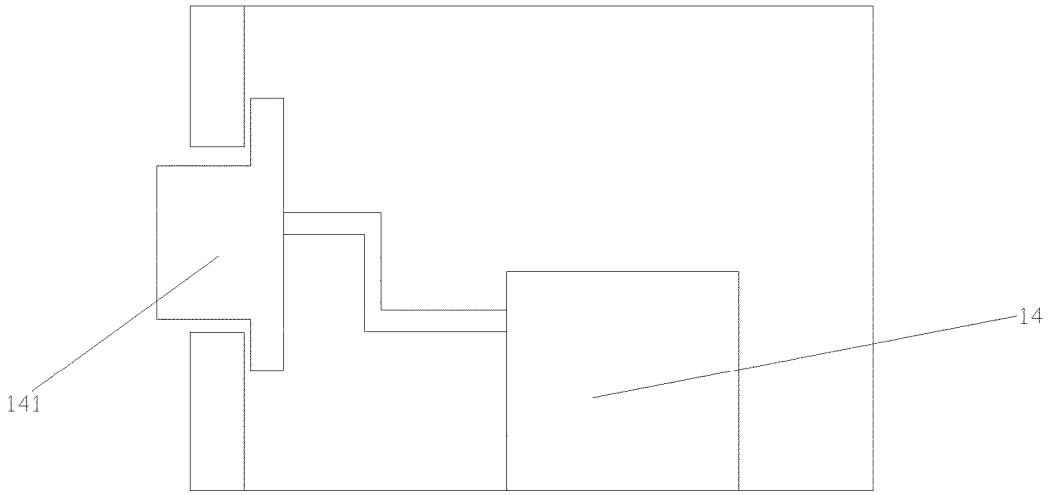
FIG. 6 is a structural diagram of the regulation device of the audio device having radio reception/Bluetooth/WI-FI functions provided by the present application.

FIGS. 1-7 have shown a preferable embodiment of the audio device having radio reception/Bluetooth/WI-FI functions provided by the present application, which comprises a device core 1 having a uniform casing size, and a personalized outer casing 2 used to accommodate the device core 1. The device core 1 comprises a casing 11, a circuit board 12 disposed within the casing 11, a speaker 13, a regulation unit 14 and a power supply unit electrically connected to the circuit board 12 respectively. The regulation unit 14 further comprises at least one of a tuning unit or a volume regulation unit. The audio device further comprises at least one manual regulation device 141 fitted for each regulation unit 14. The personalized outer casing 2 is provided with a sound transmission channel for the speaker 13 and a movement channel for allowing the manual regulation device 141 to extend outside.

The device core 1 is used for realizing the radio reception/Bluetooth/WI-FI functions, while the personalized outer casing 2 used for accommodating the device core 1 can be changed arbitrarily. The circuit board 12 of the device core 1 is used to realize the radio reception/Bluetooth/WI-FI functions, the speaker 13 is used to transmit sound, the regulation unit 14 is used to regulate the operating state of the audio device, and the casing 11 is used to accommodate the components of the device core 1. The regulation unit 14 can be a tuning unit 141, a volume regulation unit 142, or a tuning unit 141 and a volume regulation unit 142, which can be selected freely according to the user's requirements.

The power supply unit of the audio device comprises a rechargeable battery and a charging circuit for charging the rechargeable battery, for supplying electrical power to the audio device.

The device core 1 further comprises an LED indication unit 15 electrically connected with the circuit board 12, and the personalized outer casing 2 is provided with a light transmission channel with a lens arranged inside at a corresponding position. The LED indication unit 15 is arranged at the outer surface of the device core 1, and the operating state of the audio device can be seen from outside through the lens.

Figure 7:
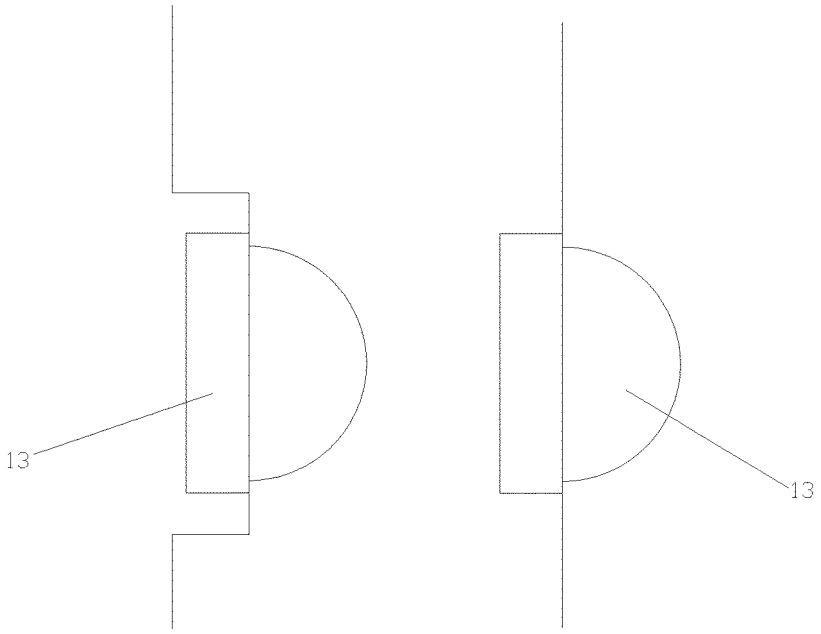
FIG. 7 is a structural diagram of the speaker of the audio device having radio reception/Bluetooth/WI-FI functions provided by the present application.

In the present embodiment, the casing 11 comprises a front surface 111, a rear surface 112 and an enclosure 113 between the front surface 111 and the rear surface 112. The speaker 13 is movably mounted on the front surface 111 of the casing 11 and the sound transmission channel on the personalized outer casing 2 is opposite to a speaker cone 131 of the speaker 13. Furthermore, the front surface 111 of the casing 11 is provided with a groove 1111 for installing the speaker 13, wherein the groove 1111 has a groove depth greater than a height and vibration amplitude of the speaker cone 131, such that an inner wall of the personalized outer casing 2 will not affect a vibration of the speaker cone 131. FIG. 7 has shown two installation modes of speaker 13, in which the speaker 13 can be placed in the corresponding groove of the casing 11 or in the corresponding channel of casing.

The present embodiment also includes a decorative horn cloth 16 movably arranged on the sound transmission channel of the personalized outer casing 2. The decorative horn cloth 16 can be made of leather, cloth, plastic or any other flexible material. Different colors and patterns can be printed on the horn cloth according to the different requirements of users to satisfy the user's individual requirements. A horn network also can be employed without departing from the conception of the present application.

In the present embodiment, the audio device having radio reception/Bluetooth/WI-FI functions further comprises a rotary knob 17, and the manual regulation device 141 comprises a frequency tuning or a volume potentiometer, or a shaft of a key or a switching or a shaft combination of a key or a switching. One end of the manual regulation device 141 is coupled with a rotating shaft of the regulation unit 14, and other end of the manual regulation device 141 is coupled with the rotary knob 17. The movement channel of the manual regulation device 141 is a through hole. A circular or partially circular arc dial 18 is mechanically and movably mounted around the through hole. The arranged rotary knob 17 can be used to adjust the frequency or volume of the radio of the audio device, and a more precise adjustment can be implemented when cooperating with the dial 18.

In the present embodiment, the audio device having radio reception/Bluetooth/WI-FI functions further comprises a handle 19. The manual regulation device 141 further comprises a displacement regulation arm of a toggle switch, a displacement potentiometer or a multi-segment switch. The movement channel of the manual regulation device 141 is a narrow long slot, and the handle 19 is inserted or sleeved on the displacement regulation arm.

Since the handle and the displacement regulation arm are movable inserted together, there can be multiple options.

In the present embodiment, the audio device having radio reception/Bluetooth/WI-FI functions further comprises a narrow long indication device 101 movably mounted at one side of the narrow long slot of the personalized outer casing 2.

Embodiment

In the present embodiment, the audio device having radio reception/Bluetooth/WI-FI functions further comprises a footpad 102 movably mounted on a base of the personalized outer casing 2 via an insertion, clamping or screwing connection. The footpad 102 is arranged at the bottom of the personalized outer casing 2 to enable the audio device to be placed stably. The footpad can be made of plastic or rubber materials, and be evenly distributed at the bottom of the personalized outer casing 2. The material, shape and color of the footpad can obtain a welcome design through collecting user's suggestions, such that even the design of the whole device is relatively unchanged, just the footpad can bring in new meaning to the whole device.

Embodiment

In the present embodiment, the personalized outer casing 2 comprises six panels, namely, a front panel 22, a rear panel 23, and a top panel 24, a bottom panel 25, a left panel 26 and a right panel 27 arranged between the front panel 22 and the rear panel 23. Wherein, the top panel 24, bottom panel 25, left panel 26, right panel 27 and rear panel 23 are integrated as a whole. The rear panel 23 is pre-retained with connector through holes 231 and sound through holes 232, while the front panel 21 can be movably mounted at an opening enclosing by the five panels. The movable front panel can facilitate the user to exchange the components of the device core through removing the front panel, thus satisfying the DIY requirements of different groups of people.

Embodiment

In the present embodiment, an audio device suit is provided. Such audio device suit comprises one device core and two personalized outer casings, in which the first personalized outer casing 2 is made of silver metal surface materials, and the second personalized outer casing 2 is made of plastic materials coated with different patterns on the surface. This personalized outer casing provides a variety of options for personalization. The personalized outer casing 2 can be made of cortex, wood or plastic with any personalized pattern. All kinds of materials and patterns can be combined to form a different personalized outer casing at will.

Embodiment

In the present embodiment, two groups of decorative accessories respectively matching with the personalized outer casing 2 are provided, which at least comprise two groups of manual regulation devices 141 and decorative horn cloths 16 matched with the personalized outer casing respectively. The manual regulation devices 141 and decorative horn cloths 16 can also have a variety of choices. The manual regulation devices 141 can be designed to have different shapes with any color or pattern on the outer surface. The decorative horn cloths 16 can be made of leather or plastic materials with any color or pattern on the outer surface. Such color and pattern can be matched according to different needs for satisfying the aesthetic requirements and demands of different consumers.

Embodiment

In the present embodiment, the audio device having radio reception/Bluetooth/WI-FI functions is further provided with a charging interface, an external antenna interface, a headphone jack interface, an AUX IN input interface, and a self-defined extensible external function connection interface 103 at its rear part. In order to meet more functional requirements, the rear part of the audio device of the present application has a multi-function interface, which includes a power supply (including charging), external antenna, external input, external output and function extensible interface (e.g., external subwoofer), to meet various requirements of different groups of people.

Embodiment

In the present embodiment, the audio device having radio reception/Bluetooth/WI-FI functions is further provided with a time/temperature display unit mounted on a panel of the personalized outer casing 2 for showing time and temperature in the confined spaces.

Embodiment

In the present embodiment, the audio device having radio reception/Bluetooth/WI-FI functions further comprises a tuning indication unit which is prominently mounted on a panel of the device core 1, wherein the tuning indication unit is electrically connected with the circuit board 12, and the personalized outer casing 2 is reserved with a visual channel at a corresponding position of the tuning indication unit. The tuning indication unit can show the changes of each data when adjusting the audio device, which make the use of the audio device more convenient.

Embodiment

The method embodiment of the present application has provided a customization method for an audio device having radio reception/Bluetooth/WI-FI functions. The customer can access the server via WEB site or APP and customize product according to following steps after registration:

S1) sending personal voice preference options to the server which provides sound quality parameters for selection according to a preset table;

S2) selecting or setting sound quality parameters by referring to suggestions provided by the server and sending them to the server;

S3) recommending speaker options according to above selections by the server;

S4) selecting a speaker satisfying customer's requirements from the speaker options provided by the server and sending it to the server;

S5) selecting a personalized outer casing from multiple personalized outer casings recommended by the server and sending it to the server;

S6) selecting a decorative accessory from multiple decorative accessories recommended by the server according to selected personalized outer casing and sending it to the server, wherein the decorative accessory comprises a rotary knob;

S7) selecting required function module from function expansion modules recommended by the server according to preference and sending it to the server.

In this way, the customization for an audio device having radio reception/Bluetooth/WI-FI functions with user's individual requirement characteristics can be completed.

The assembly method for an audio device having radio reception/Bluetooth/WI-FI functions is provided, which comprising following steps: S1) selecting sound quality parameters according to sound preferences; S2) recommending a speaker according to selected sound quality preferences; S3) selecting a personalized outer casing from recommended personalized outer casings according to the sound quality parameters and the speaker; S4) selecting a decorative accessory from recommended decorative accessories according to selected personalized outer casing, wherein the decorative accessory comprises a rotary knob; S5) installing selected circuit into a casing circuit board, installing the speaker on the personalized outer casing, installing a device core in the personalized outer casing and arranging selected decorative accessory; S6) connecting a function expansion module or device according to reference from external.

When implementing the audio device having radio reception/Bluetooth/WI-FI functions according to the present application, the following beneficial effects can be obtained. By adding Bluetooth and Wi-Fi to the original radio function, the audio device can have more diversified functions. The audio device can be connected to both the traditional radio stations and the Internet to satisfy the requirements of different groups. In particular, the functional part of the present application can also be independently DIY with various accessories (including external components, such as outer casing, rotary knob, dial, horn mesh cover, decorative accessories, etc.). In addition, the device core can also have different sound style characteristics, which makes the audio device more personalized and can meet the aesthetic requirements of different people.

The above contents are only better embodiments of the present application. For one skilled in the art, according to the idea of the present application, many changes can be made in the specific implementation and application scope. As long as these changes are not divorced from the concept of the present application, such changes all belong to the protection scope of the present application.

What is claimed is:

1. An audio device having radio reception/Bluetooth/WI-FI functions comprising a device core (1) having a uniform casing size, and a personalized outer casing (2) used to accommodate the device core (1); wherein the device core (1) comprises a casing (11), a circuit board (12) disposed within the casing (11), a speaker (13), a regulation unit (14) and a power supply unit electrically connected to the circuit board (12) respectively; wherein the regulation unit (14) further comprises at least one of a tuning unit or a volume regulation unit; wherein the audio device further comprises at least one manual regulation device (141) fitted for each regulation unit (14); the personalized outer casing (2) is provided with a sound transmission channel for the speaker (13) and a movement channel for allowing the manual regulation device (141) to extend outside; wherein the casing (11) comprises a front surface (111), a rear surface (112) and an enclosure (113) between the front surface (111) and the rear surface (112), wherein the speaker (13) is movably mounted on the front surface (111) of the casing (11) and the sound transmission channel on the personalized outer casing (2) is opposite to a speaker cone (131) of the speaker (13); wherein the front surface (111) of the casing (11) is provided with a groove (1111) for installing the speaker (13), wherein the groove (1111) has a groove depth greater than a height and vibration amplitude of the speaker cone (131), such that an inner wall of the personalized outer casing (2) will not affect a vibration of the speaker cone (131); wherein the audio device having radio reception/Bluetooth/WI-FI functions further comprises a rotary knob (17), wherein the manual regulation device (141) comprises a frequency tuning or a volume potentiometer, or a shaft of a key or a switching or a shaft combination of which, wherein, one end of the manual regulation device (141) is coupled with a rotating shaft of the regulation unit (14), and other end of the manual regulation device (141) is coupled with the rotary knob (17), wherein, the movement channel of the manual regulation device (141) is a through hole; wherein the personalized outer casing (2) comprises six panels, namely, a front panel (22), a rear panel (23), and a top panel (24), a bottom panel (25), a left panel (26) and a right panel (27) arranged between the front panel (22) and the rear panel (23), wherein, the top panel (24), the bottom panel (25), the left panel (26), the right panel (27) and the rear panel (23) are integrated as a whole, wherein the rear panel (23) is pre-retained with connector through holes (231) and sound through holes (232), while the front panel (22) can be movably mounted at an opening enclosing by five panels.

2. The audio device having radio reception/Bluetooth/WI-FI functions according to claim 1, wherein the device core (1) further comprises an LED indication unit (15) electrically connected with the circuit board (12), wherein the personalized outer casing (2) is provided with a light transmission channel with a lens arranged inside at a corresponding position.

3. The audio device having radio reception/Bluetooth/WI-FI functions according to claim 1, wherein further comprises a decorative horn cloth (16) movably arranged on the sound transmission channel of the personalized outer casing (2).

4. The audio device having radio reception/Bluetooth/WI-FI functions according to claim 3, wherein further comprises a circular or partially circular arc dial (18) mechanically and movably mounted around the movement channel of the manual regulation device (141).

5. The audio device having radio reception/Bluetooth/WI-FI functions according to claim 1, wherein further comprises a handle (19), the manual regulation device (141) further comprises a displacement regulation arm of a toggle switch, a displacement potentiometer or a multi-segment switch; wherein the movement channel of the manual regulation device (141) is a narrow long slot, and the handle (19) is inserted or sleeved on the displacement regulation arm.

6. The audio device having radio reception/Bluetooth/WI-FI functions according to claim 5, wherein further comprises a narrow long indication device (101) movably mounted at one side of the narrow long slot on the personalized outer casing (2).

7. The audio device having radio reception/Bluetooth/WI-FI functions according to claim 1, wherein further comprises a footpad (102) movably mounted on a base of the personalized outer casing (2) via an insertion, clamping or screwing connection.

8. The audio device having radio reception/Bluetooth/WI-FI functions according to claim 1, wherein at least comprises two personalized outer casings (2) each made of different materials or coated with different patterns.

9. The audio device having radio reception/Bluetooth/WI-FI functions according to claim 8, wherein at least comprises two groups of decorative accessories, manual regulation devices (141), decorative horn cloths matched with the personalized outer casing (2).

10. The audio device having radio reception/Bluetooth/WI-FI functions according to claim 1, wherein is further provided with a charging interface, an external antenna interface, a headphone jack interface, an AUX IN input interface, and a self-defined extensible external function connection interface (103) at its rear part.

11. The audio device having radio reception/Bluetooth/WI-FI functions according to claim 1, wherein the power supply unit comprises a rechargeable battery and a charging circuit for charging the rechargeable battery.

12. The audio device having radio reception/Bluetooth/WI-FI functions according to claim 1, wherein further comprises a time/temperature display unit mounted on a panel of the personalized outer casing (2).

13. The audio device having radio reception/Bluetooth/WI-FI functions according to claim 1, wherein further comprises a tuning indication unit which is prominently mounted on a panel of the device core (1), wherein the tuning indication unit is electrically connected with the circuit board (12), and the personalized outer casing (2) is reserved with a visual channel at a corresponding position of the tuning indication unit.

* * * * *